US007529382B2

(12) United States Patent
Babb

(10) Patent No.: US 7,529,382 B2
(45) Date of Patent: May 5, 2009

(54) HIGH FIDELITY LOUDSPEAKER

(75) Inventor: Burton A. Babb, 6618 Briarhavan Dr., Dallas, TX (US) 75240

(73) Assignee: Burton A. Babb, Dallas, TX (US)

( * ) Notice: Subject to any disclaimer, the term of this patent is extended or adjusted under 35 U.S.C. 154(b) by 0 days.

(21) Appl. No.: 11/779,267

(22) Filed: Jul. 17, 2007

(65) Prior Publication Data

US 2008/0069393 A1 Mar. 20, 2008

Related U.S. Application Data

(60) Provisional application No. 60/831,376, filed on Jul. 17, 2006.

(51) Int. Cl.
*H04R 7/02* (2006.01)

(52) U.S. Cl. ..... 381/427; 381/426

(58) Field of Classification Search ..... 381/396, 381/423, 426, 427, 428, 431, 432; 181/148, 181/149, 157, 167, 168, 169, 170
See application file for complete search history.

(56) References Cited

U.S. PATENT DOCUMENTS 3,508,626 A * 4/1970 Robbins ..... 181/168
3,925,626 A * 12/1975 Stallings, Jr. ..... 381/396
3,953,675 A 4/1976 Babb
3,983,337 A 9/1976 Babb
D244,698 S 6/1977 Babb
4,115,667 A 9/1978 Babb
4,144,416 A 3/1979 Babb
4,188,711 A 2/1980 Babb
4,205,205 A 5/1980 Babb
4,225,756 A 9/1980 Babb
4,225,757 A 9/1980 Babb
4,297,537 A 10/1981 Babb
D261,642 S 11/1981 Babb
D261,645 S 11/1981 Babb
5,664,023 A 9/1997 Button
6,111,969 A 8/2000 Babb
6,721,435 B2 4/2004 Babb et al.
6,740,202 B2 * 5/2004 Ishigaki et al. ..... 381/426
2001/0033673 A1 10/2001 Babb et al.
2002/0094103 A1 7/2002 Babb et al.
2005/0196012 A1 9/2005 Babb et al.
2008/0069393 A1 3/2008 Babb

FOREIGN PATENT DOCUMENTS

GB 2 064 999 A * 6/1981
GB EP 065 882 * 9/1982
JP 83041038 B * 9/1983

* cited by examiner

*Primary Examiner*—Brian Ensey
(74) *Attorney, Agent, or Firm*—Gardere Wynne Sewell LLP

(57) ABSTRACT

A small and highly efficient loudspeaker, capable of handling high power, yet capable of being manufactured at reasonable cost, uses energy absorbing surfaces on a rear side of its diaphragm and as part of an enclosure that is integrated with its frame.

8 Claims, 2 Drawing Sheets

HIGH FIDELITY LOUDSPEAKER

This application claims the benefit of U.S. provisional patent application No. 60/831,376, filed Jul. 17, 2006 by Burton A. Babb, which is incorporated by reference for all purposes.

TECHNICAL FIELD OF THE INVENTION

The invention relates generally to acoustic loudspeakers.

BACKGROUND

The ability to transfer heat from the voice coil is a basic design limit of high power loudspeakers. Magnets and plates surrounding the voice coil are not made of high thermal conductivity materials. The insulation wrapping the voice coil wire is by definition insulation, and barely conducts heat to the air surrounding the voice coil. The air layer around the voice coil is almost an ideal insulator. This doubly insulated voice coil works in constrained air spaces that quickly rise in temperature. This rising temperature in the neighborhood of the coil aggravates the increasing temperature of the voice coil wire and the associated efficiency loss of the voice coil. Efficiency of the coil could be increased by adding additional layers of winding to the coil, but this results in additional heating of interior coil wire windings where the coil wire is surrounded on three or four sides by hot coil wire and has to rise above the temperature of its neighborhood coil wire to dissipate the heat generated by the current it carries.

Eventually every loudspeaker meets its threshold where an increase in voltage causes enough coil resistance increase so the current in the coil decreases and the loudness of the loudspeaker goes down. See U.S. Pat. No. 5,664,023. One solution to this problem would be to increase the room temperature efficiency of the speaker, but this has not worked well for woofers where attempting to increase the efficiency in a given size structure causes a decrease in low frequency performance.

Furthermore, a high power, high efficiency full range, flat frequency response single diaphragm loudspeaker that images as an ideal point source is a very difficult objective when all the other objectives listed above are to be simultaneously met. Meeting this ideal point source requirement means being an omni directional source with no phase shifts as a function of radiated angle or distance.

SUMMARY OF THE INVENTION

The invention pertains generally to solving one or more of the problems noted above. The invention will be described in connection with a small, efficient, broadband loudspeaker, in which it can be employed to particular advantage. This loudspeaker can handle high power and can be manufactured at reasonable cost. The loudspeaker has an integrated loudspeaker and enclosure.

In accordance with one aspect of this loudspeaker, a curved waveguide structure disposed to the rear of, and near to, a loudspeaker diaphragm creates multiple acoustic energy-absorbing reflections, which enables the making of an integrated speaker and enclosure that does not reflect significant acoustic energy back to the diaphragm. Multiple curved paths are formed, for example by integrally incorporating them into a loudspeaker frame, for absorbing unwanted heat and acoustic energy from behind the loudspeaker diaphragm and transmitting the absorbed energy to the environment outside the frame. When a group of air molecules strikes a glancing blow to a reflective curved surface the molecules next to the surface are slowed down as they pick up rotational energy and in effect become captured by the surface. Energy is absorbed by the surface as the air molecules roll along, and the air molecules lose energy and slow down. In a preferred embodiment for a loudspeaker having a voice coil driving a diaphragm, the curved paths are comprised of curved fins or blades, extending outwardly from near voice coil, in a radial fashion. A curved waveguide placed in a frame with a mounting flange suitable for sealing to the front of an exhaust fan or blower for cooling electrical or electronic equipment such a curved waveguide is capable of absorbing a substantial amount of the noise.

In accordance with another feature of this loudspeaker, a thin layer or film of highly conductive material, such as copper, is formed on some or most of the surfaces within the loudspeaker and/or its enclosure, against which undesirable acoustic or thermal energy is directed The highly conductive layer is then covered by a thin film of very low contact resistance material that prevents oxidation. One example of low contact resistance material is Ag-20 Sn alloy. Such material has contact resistance less than 0.01 ohms per square inch. In the preferred embodiment, this low contact resistance material is electroplated onto a surface that has first been plated with electro less nickel and then electroplated with copper. This results in a thin film or layer that absorbs acoustic energy without adding significant mass. When this low contact resistance material is struck by air molecules energy is transferred to or from the air molecules to bring the air almost instantly into thermal equilibrium with the copper conductive layer. When either audio energy or heat energy in the air hits the surface the collision is not elastic and the air molecules leaving the surface do not contain audio energy beyond that caused by any audio motion of the substrate (e.g. diaphragm) to which the film is applied.

In a preferred embodiment, the highly conductive, energy absorbing coating is applied to rear surfaces of a diaphragm, resulting in a lower efficiency of coupling acoustic energy to air molecules hitting the rear of the diaphragm as compared to a relatively higher efficiency of coupling acoustic energy to air molecules hitting the front of the diaphragm. This film is also preferably formed on some or most of the surfaces enclosing the rear of the speaker and to any energy absorbing waveguides within the enclosure. Furthermore, the front side of an diaphragm is preferably coated to enhance its elastic properties by extending, on a micro scale, the effective surface area of the front side of the diaphragm, which results in enhanced coupling of acoustic energy from diaphragm to the air.

Use of this type of coating and the texturing and together with curved waveguide results in an energy control process that can also be used to create flexible lightweight noise absorbing wall panels.

These features, each individually as well as working together in combination, enable manufacture of a high power, high efficiency full range, flat frequency response single diaphragm loudspeaker that images as an ideal point source. Creating an ideal point source is a very difficult goal when all the other goals listed above are to be simultaneously met. Independent control of the audio energy flow and the heat energy flow allows the creation of a full range integrated loudspeaker and enclosure.

DETAILED DESCRIPTION OF EXEMPLARY EMBODIMENTS

In the following description, like numbers refer to like elements.

Figure 1:
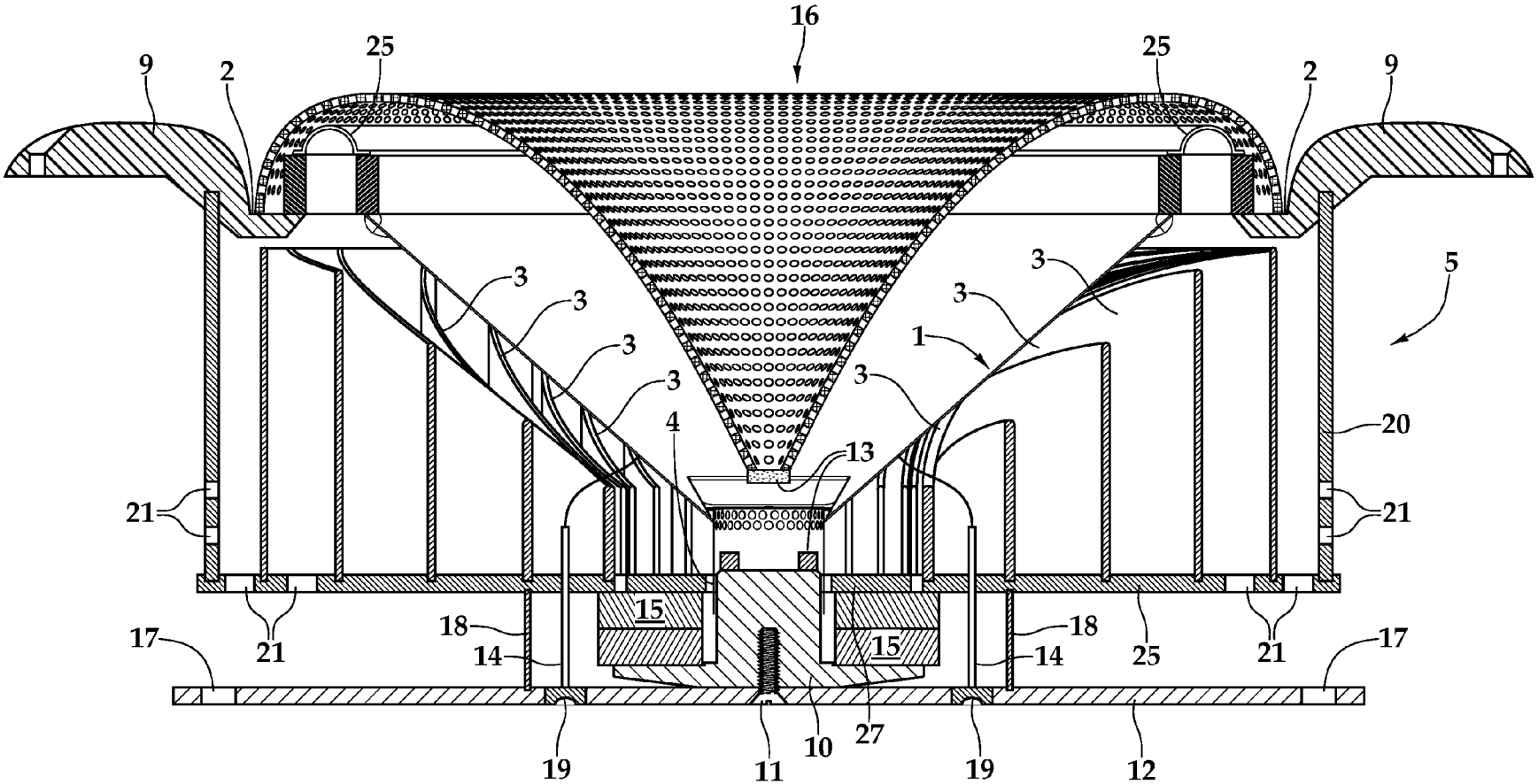
FIG. 1 is a cross-section of an exemplary loudspeaker with an integrated, energy-absorbing enclosure.
Figure 2A:
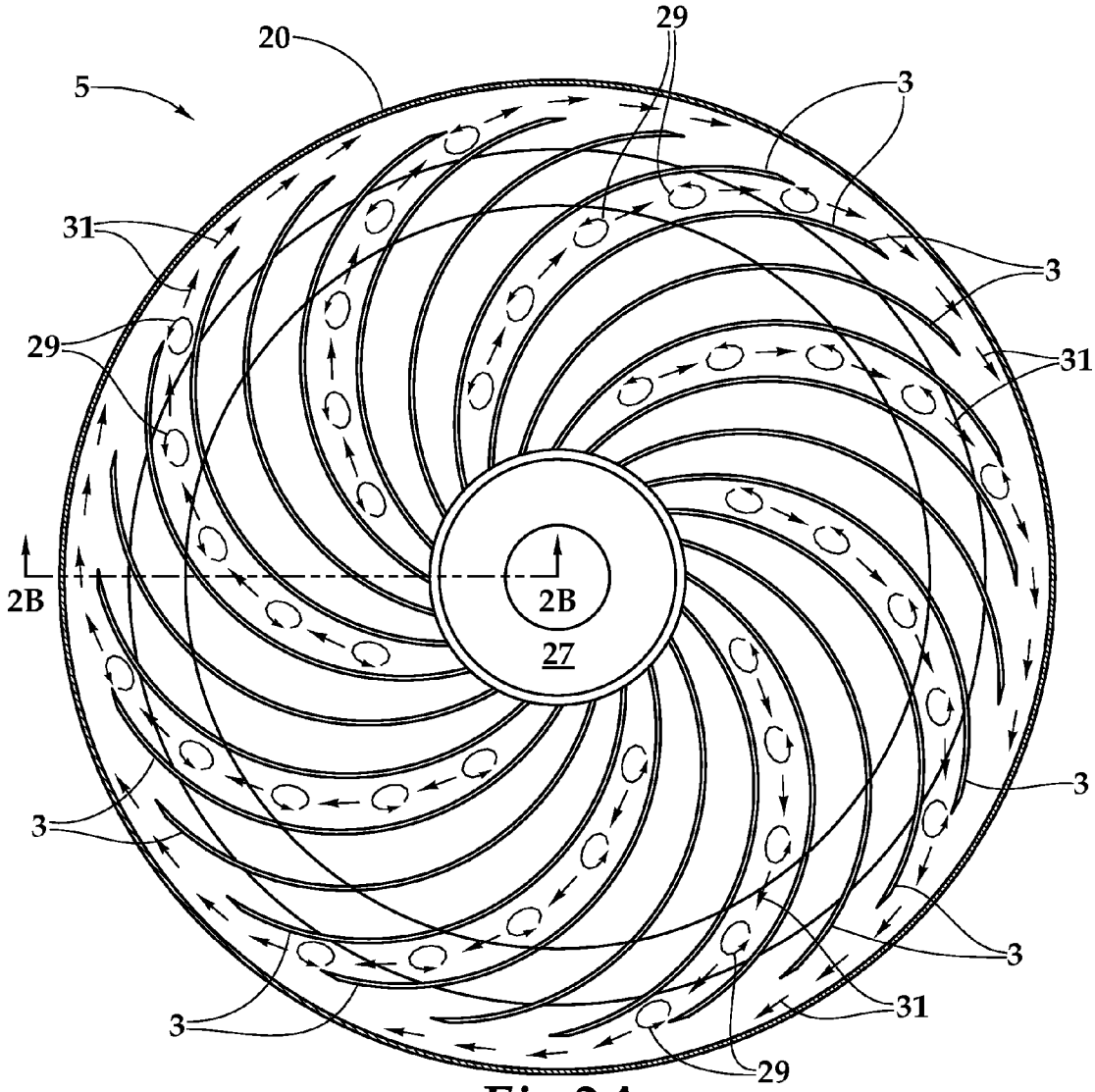
FIG. 2A is a plan view of a curved waveguide structure shown in FIG. 1.
Figure 2B:
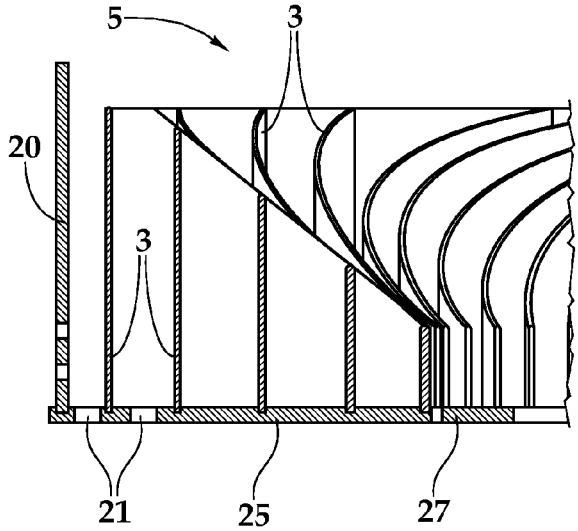
FIG. 2B is a quarter-section of FIG. 2, taken along section lines 3-3.

Referring to FIGS. 1, 2A and 2B, various features of the invention will be described in reference to an exemplary loudspeaker, which is comprised of a diaphragm 1 coupled with a voice coil 4 suspended in flux gap formed by magnets 15. In this example, the diaphragm is cone-shaped, which works well as a broad-band loudspeaker, as well as one used for lower frequency reproduction. However, certain aspects of the invention can be employed with other shapes of diaphragms including, for example, dome and flat diaphragms, and combinations of different types.

Voice coil 4 is preferably of a type formed by spaced apart turns, as described in U.S. published patent application No. 2005/0196012, which is incorporated herein by reference. Spacing between adjacent turns is at least 50% of the width or diameter of the wire, and preferably between 75% and 150% of the width of the wire. The wire can have either a circular or rectangular cross-section.

There are two mounting flanges 12 and 9 on this example. The front flange 9 is for flush mounting the speaker. The rear flange 12 is for surface mounting and will fit through the mounting hole diameter for flush mounting. The rear flange has mounting holes 17 and is a cast or aluminum plate that is bolted with bolt 11 on the yoke 10 and has provisions for mounting connectors 19 for the silver plated copper lead wire 14, which in turn is connected with the voice coil. A steel magnetic ring 18 for shielding the magnet assembly may also be installed if desired.

The diaphragm is suspended from land 2, which is connected with flange 9, using a suspension generally designated 25. In this example, the suspension is substantially similar to the one described in U.S. Pat. No. 6,111,969 of Babb.

An array comprised of a plurality of curved deflectors 3 angled down with the closest end a fixed distance behind the diaphragm to provide space to allow for cone excursion. Air molecules leaving the rear face of the diaphragm, which is coated with a conductive coating described below, should have primarily spin energy and should not travel far. The molecules leaving the diaphragm face should be traveling slowly and in a direction perpendicular to the cone face that puts them on path direction to enter the deflector array at an optimum angle to get caught up and have energy absorbed by the deflectors.

The presence of rotational, also called "transverse" or "shear" audio energy which is not supported or transmitted as an audio wave but is continuously created in air per the requirements for equipartition of energy will cause audio attenuation by molecular relaxation. The curved deflectors are designed to convert longitudinal audio energy from the rear of the diaphragm into rotational audio energy, generally indicated in FIG. 2 by circular arrows 29, that will not convert into an audio wave but will drift around and attenuate, thereby resulting in audio attenuation. As generally indicted by arrows 31 in FIG. 2, enclosure 20 contains this drifting rotational energy and dissipates this rotational audio energy as it rolls around the inside wall of the enclosure. It does not let this rotational audio energy escape until it is reduced to a level that will not cause attenuation of the longitudinal audio energy from the front of the diaphragm.

The curved deflector array 3, flange 9, cylindrical enclosure 20, and plate 25 comprise an integrated frame assembly and enclosure, generally designated 5.

In this embodiment, the rear surface of substrate forming diaphragm 1 is coated with a highly conductive coating or film with a surface having low contact resistance. The substrate is, in this example, made of aluminum or aluminum alloy (such as alloy 5052). The coating conducts heat and acts to absorb acoustic energy and heat, resulting in heat energy transmitted primarily to the rear of the diaphragm and audio energy being transmitted primarily from the front of the diaphragm. In a preferred embodiment, the coating is made from at least one layer of copper. The copper can be applied to a base layer of nickel or nickel alloy. Because copper oxidizes, forming an insulating film, a surface layer of a silver and tin alloy, preferably Ag-20 Sn, is applied to prevent oxidization and provide a coupling to the air of low contact resistance. The nickel, copper and Ag-20 Sn layers are preferably applied using an electro-plating or other process that results in uniform, relatively thin layers.

A low contact resistance layer made from, for example, Ag-20 Sn works by not having electrical impedance between the sea of electrons that are always on the surface of conductive metals and the air. It is a very thin layer of very conductive metal that has a very low contact resistance, which is a measure of the impedance seen by the outside world. Since the Ag-20 Sn is very thin, it alone does not contribute much to the overall conductivity, which is measured by the density of the surface electron field. The higher the conductivity of the substrate metal the denser the surface electron field and the more conductivity per square. With a very thin layer of copper under the Ag-20 Sn, measured conductivity of the plating has one value, and if the copper substrate is made 100 times thicker the thermal conductivity of the coating is approximately 100 times as great. There may be little correlation between the measured thermal conductivity of the plating and the absorption of heat or audio energy. For conductive coating a thin copper layer is best for use on the diaphragm or the voice coil where overall mass is critical, and much thicker layers of copper can be used for all other areas, on which the conductive coating is formed.

The conductive, energy absorbing thin coating or film such as described above provides the principal heat and audio transmission line feeding both types of energy to the cone. There are secondary heat paths that are greatly enhanced by applying the conductive coating on both the inside and the outside surface of the voice coil and on the cast-in top plate 27, the yoke 10 and the rear flange 12. The air next to the voice coil is surrounded by surfaces with the conductive coating that allow the air to remain in thermal equilibrium with the silver and copper substrates that are part of the conductive coating process. The air does not have oxide barriers or contact potentials to overcome, and to the extent that thermal motion and motion of the voice coil keep the air circulating a little bit, the thin layers of air become good conductors of heat and voice coil heat is transmitted to the yoke and top plate where the conductive coating conducts the heat away. It appears as though this facilitation of heat conduction along the plates may increase heat conduction just as much as the heat conduction out along the diaphragm.

The front of the diaphragm is also preferably treated to increase acoustic coupling by increasing the micro surface area of diaphragm. Spray textures such as Homax Products Inc. orange peel spray texture put on with the fine spray tube works by not only having the outer surface textured but also by having the outer layer crack and shrink away from the inner dried layer, providing a large surface multiplier. This paint can be applied over plater's mask or a paint protectant intentionally left in place when the rear of the diaphragm is plated.

The front surface of the diaphragm can also be a thin layer of textured diamond pattern enamel or it can be a pressure sensitive adhesive backed tape made of non-absorbent material that has 0.005" high ridges stamped into the tape. The outside of the frame 5 is like the front of the cone in that its coupling to the outside air can be improved by, for example, grooves molded into the outer surface of the frame or ridged tape applied to the outside of the frame.

Cylindrical enclosure 20 is, in this example, formed using a 005" thick,continuous curved wall of aluminum alloy 5052, which is cemented on to the aluminum plate 25. The inside surface of the cylindrical enclosure 20 is coated with a conductive coating as described above, using for example an electro-plating process, and serves as an acoustical extension of the curved pathways of the frame. If small amounts of acoustical energy exit the open outer ends of the curved frame paths, the spinning molecules strike the en closure and roll around a circular heat can path until they lose all their excess energy. Circular holes 21 are spaced around the circumference of the enclosure. When the molecules are in full thermal equilibrium with the heat can the molecules will spin into one of the holes and move out of the enclosure, carrying any buildup of heat can heat with them. Outside air, at outside temperature, will enter the holes to balance off air pressure reduction caused by air molecules spinning out of the hole. This full exchange of heat and outside air will cause the heat can to maintain itself in equilibrium with outside air temperature. It is expected that the curved paths and surfaces of the frame, covered with the conductive, energy absorbing, coating, will absorb a high percentage of the audio energy coming off the rear of the diaphragm.

By coating the yoke 10, top plate 27 and magnets 15 act as shorted turns, which prevent distortion caused by eddy currents caused by the interaction of the alternating magnetic field of the voice coil with the steady magnetic field created by the magnet. Note that the magnets 15 are stacked two deep. With little effect on heat transfer, the magnetic gap can be increased a little, which will decrease air damping in the gap and also give more tolerance to avoid noise caused by misalignment. The long travel of this relatively small diameter voice coil is increased by a lack of audio pressure loading the rear of the diaphragm, but is decreased by the choice of a large diameter diaphragm that will load the voice coil with useful reaction force caused by audio pressure on the front of the diaphragm.

The diaphragm travel is limited by a pair of soft stops 13 that stop the diaphragm before it travels too far and makes loud noise by hitting the grille 16 or the frame 5. The double-stacked magnets serve to push the top plate 27 near the gap into deep saturation so that temperature rise in the magnet will not cause a change in efficiency.

Heat conduction in air increases the attenuation of audio energy in air and can almost double normal audio attenuation factors. Separating the heat generated by the voice coil away from the audio signal exiting the front of the diaphragm will increase the audio signal, all other parameters being equal.

Frame 5 is illustrated as a separate piece in FIGS. 2A and 2B, without the mounting flange 9 which makes it useful as a loudspeaker sound absorber in either a small, integrated enclosure as shown, or in a conventional speaker enclosure, without the enclosure 20. If the mounting flange 9 is modified to mount the frame to an exhaust fan for cooling electronic or electrical equipment frame 5 will absorb the fan exhaust fan noise. If both mounting flange 9 and mounting flange 12 are modified so that the frame is adapted to fit coaxially into air conditioning ducts not only will noise in the ducts be eliminated but also privacy will be enhanced by blocking conversations or sounds from one room being transmitted through the ducts to other rooms. Cylindrical enclosure 20 is not required for these other applications.

The curved deflectors 3 are made of 5052 aluminum diaphragm material that are coated with the conductive coating of copper and a silver and tin alloy, using for example, a plating process, and formed to the right shape and curvature. The individual deflectors are then glued into slots shaped to hold the deflectors that are formed into the plate 25 that has top plate 27 molded in. The frame is injection molded of a glass filled very stiff and strong plastic such as 20% glass filled zenoy from General Electric Plastics or could be die cast.

The foregoing description is of an exemplary and preferred embodiments of a loudspeaker employing at least in part certain teachings of the invention. The invention, as defined by the appended claims, is not limited to the described embodiments. Alterations and modifications to the disclosed embodiments may be made without departing from the invention. The terms used in this specification are, unless expressly stated otherwise, intended to have ordinary and customary meaning and are not intended to be limited to the details of the illustrated structures or the disclosed embodiments. None of the description in the present application should be read as implying that any particular element, step, or function is an essential element which must be included in the claim scope. The scope of patented subject matter is defined only by the allowed claims. Moreover, none of these claims are intended to invoke paragraph six of 35 USC § 112 unless the exact words "means for" or "steps for" are followed by a participle.

What is claimed is:

1. A loudspeaker comprised of a metal or metal alloy diaphragm, mounted to a frame and coupled with a voice coil disposed within flux gap formed by a magnet assembly, the diaphragm including a front surface and a rear surface, the rear surface being coated with a thin coating comprised of one or more layers of metal or metal alloy that is relatively more conductive than the material of the diaphragm, the thin coating having surface with low contact resistance.

2. The loudspeaker of claim 1, wherein the thin coating is comprised of one or more layers of copper and a surface layer of low contact resistance material comprised of an alloy of silver and tin.

3. The loudspeaker of claim 1, wherein the alloy of silver and tin is Ag-20 Sn.

4. The loudspeaker of claim 1, wherein the thin coating is comprised of a base layer of nickel, at least one intermediate layer of copper and a surface layer of low contact resistance material.

5. The loudspeaker of claim 1, wherein the thin coating is formed at least in part by electroplating.

6. The loudspeaker of claim 1 wherein the diaphragm is comprised of a metal selected from the group of aluminum and titanium, and alloys of members of the group.

7. The loudspeaker of claim 6, wherein the diaphragm is comprised of aluminum alloy 5052.

8. The loudspeaker of claim 1, wherein the front surface is coated with a micro surface increasing material.

* * * * *